United States Patent [19]

Chouinard et al.

[11] 3,948,485

[45] Apr. 6, 1976

[54] IRREGULAR, POLYGONAL MOUNTAINEERING CHOCK

[76] Inventors: Yvon Chouinard, 235 W. Santa Clara, Ventura, Calif. 93001; Thomas M. Frost, 135 N. Evergreen Drive, Ventura, Calif. 93003

[22] Filed: Apr. 9, 1974

[21] Appl. No.: 459,430

[52] U.S. Cl. ..... 254/135 R; 24/115 R

[51] Int. Cl.[2] ..... B66D 1/00

[58] Field of Search..... 254/135 R, 190 R; 248/216; 182/133, 136, 150; 24/115, 117, 65; D34/15 FF

[56] References Cited

UNITED STATES PATENTS

| | | | |
|---|---|---|---|
| 910,192 | 1/1909 | Grouvelle et al. | 138/38 |
| 1,664,321 | 3/1928 | Quist | 24/115 R |
| 2,252,678 | 8/1941 | Beary | 35/328 |
| 3,343,514 | 9/1967 | Brett | 24/115 R |
| 3,829,825 | 8/1974 | Hawkins | 24/115 R |

*Primary Examiner*—Robert J. Spar
*Assistant Examiner*—Kenneth Noland
*Attorney, Agent, or Firm*—Wills, Green & Mueth

[57] ABSTRACT

A polygonal mountaineering chock with at least two sets of opposed faces in which extensions of each set of faces defines an acute angle, and the median distances between the two sets of opposed faces are unequal, whereby the chock can be received in holding position in cracks or openings of two different widths. A series of such chocks in graduated sizes is provided, with the distances between the sets of opposed faces being uniformly increased, such that at least one position of one chock of the series will fit into any crack of a width between the smaller end of the narrower set of faces of the smallest chock and the larger end of the wider set of faces of the largest chock.

17 Claims, 6 Drawing Figures

FIG. 1.
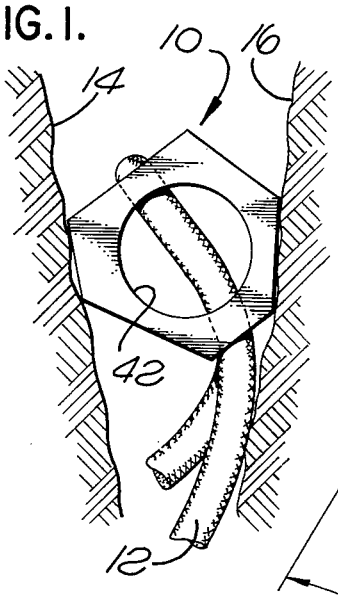
FIG. 2.
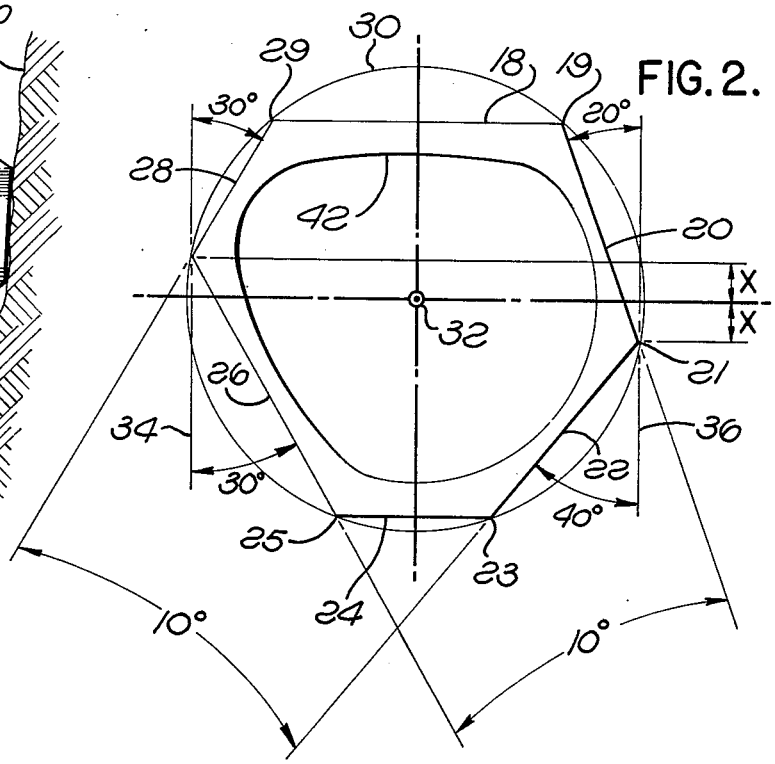
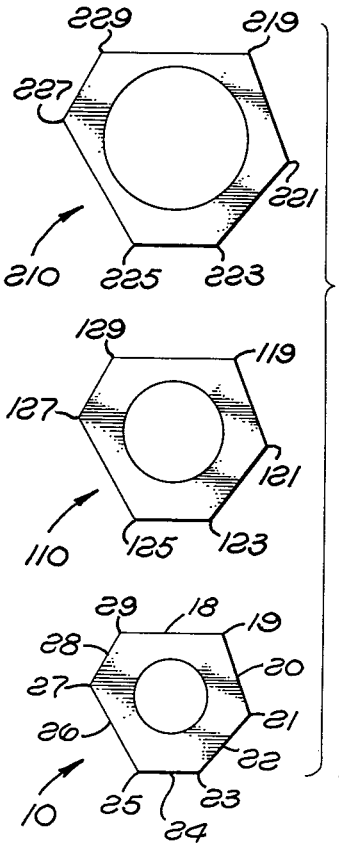
FIG. 5.
FIG. 3.
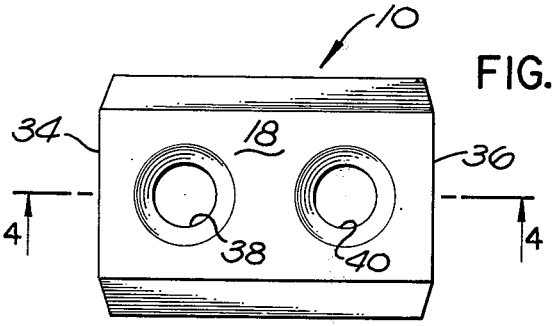
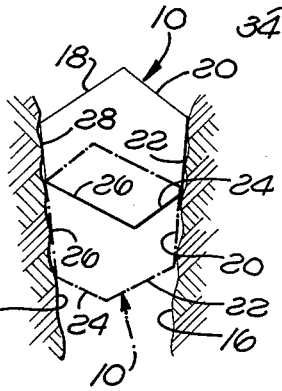
FIG. 6.
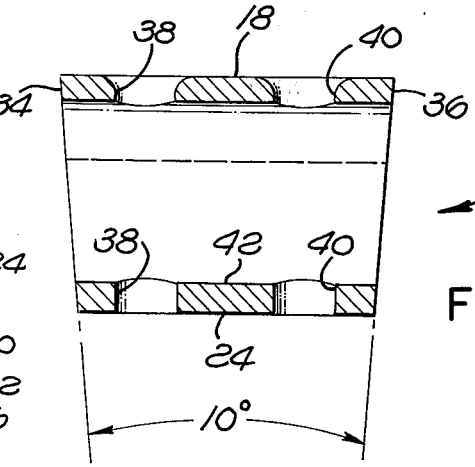
FIG. 4.

IRREGULAR, POLYGONAL MOUNTAINEERING CHOCK

BACKGROUND AND BRIEF SUMMARY OF THE INVENTION

The present invention relates generally to the mountaineering art, and more particularly to a novel irregular, polygonal mountaineering chock for wedging into cracks and openings in rocks to provide protection or support for a climber.

As is well known in the mountaineering art, a climber uses various types of mechanical aids for anchoring and for the attachment of slings and the like to assist in the assent and decent of a wall of rock. These include various types and shapes of pitons, chocks, hooks and bolts.

Although pitons are possibly the most well-known and widely used mechanical aid, the use of chocks has increased and the use of pitons has decreased during recent years, due to the interest in free climbing and because chocks are less likely to scar and flake the rock because they are wedged by hand into position in cracks and piton holes, rather than being driven with a hammer.

Metal chocks for climbing evolved from the use of ordinary machine nuts collected alongside of the Snowdon Railway tracks as climbers hiked up the Clogwgn du'r Arddu. Because these nuts were of uniform or regular hexagonal shape, they could be fitted into a crack in only one attitude. Also, in cracks which bottleneck or converge over a short distance, this type of uniform shape does not present a problem, but in those instances were the walls of the cracks are substantially parallel, such chocks of uniform or regular hexagonal shape are unsatisfactory.

In recent years, "off-set" hexagonal chocks have been produced in which two opposed faces are shortened an equal amount and the opposed adjacent faces are lengthened an equal amount, to provide a slight acute angle between opposed faces so as to fit between slowly converging walls. Although said "off-set" chocks constituted a considerable improvement over the uniform hexagonal shape, they provided only one size per chock for use with such slowly converging walls.

With the aforementioned limitations and defficiencies of known chocks in mind, it is an object of the present invention to provide a novel irregular, polygonal mountaineering chock which can be used with slowly converging walls or cracks and which provides a plurality of sizes or widths in a single chock for such purpose. More particularly, it is an object to provide such a chock which is of irregular or non-uniform hexagonal shape and which include two widths or sizes in two separate attitudes for use with slowly converging walls or cracks.

Another object is to provide a series of such chocks which will fit in any width of slowly converging crack, from a predetermined minimum width to a predetermined maximum width. More particularly, it is an object to provide a series of such chocks in which the larger end of the wider set of opposed faces of one chock in the series is the same as the smaller end of the narrower set of opposed faces of the next larger chock in the series.

Yet another object is to provide such a series of chocks in which the opposed ends of the chocks are disposed at an acute angle and the chocks are of varying lengths to also provide a range of sizes to accommodate cracks of varying widths.

We have discovered that the above objects and advantages are achieved with a series of irregular, polygonal chocks, preferably hexagonal in shape, having at least two sets of opposed faces with each set converging at an acute angle, preferably ten degrees, and in which the spacing between faces in each set is unequal. In the preferred construction, the larger end of the narrower set of faces is substantially the same size as the smaller end of the wider set of faces. In addition, in the preferred series of chocks of different sizes, the larger end of the wider set of faces of one chock is substantially the same size as the smaller end of the narrower set of faces of the next larger chock.

BRIEF DESCRIPTION OF THE DRAWING

In the drawing:

FIG. 1 is a perspective view of a mountaineering chock embodying the teachings of the present invention, shown wedged in a slowly converging crack in a rock and supporting a sling;

FIG.2 is an enlarged end view of the chock of FIG. 1, showing the angular relationships of the various faces;

FIG. 3 is a top plan view of a typical chock;

FIG. 4 is a vertical sectional view taken on the line 4—4 of FIG. 3;

FIG. 5 is an end view of three chocks of different sizes taken in sequence from a series of such chocks; and FIG. 6 is a somewhat schematic end view similar to FIG. 1 showing the same chock in two different attitudes, approximately sixty degrees apart, illustrating the different spacing between sets of faces but with said sets of faces having the same angle of inclination.

DESCRIPTION OF THE PREFERRED EMBODIMENT

Referring to the drawing more particularly by reference numerals, and specifically to FIG. 1, the number 10 indicates a novel irregular polygonal mountaineering chock constructed in accordance with the teachings of the present invention, shown supporting a portion of a rope sling 12 and wedged between the opposed walls 14 and 16 of a crack in a rock wall.

The chock 10 (FIG. 2) is preferably made from bar aluminum and is of hexagonal cross-section with faces 18, 20, 22, 24, 26 and 28, which intersect at parallel edges 19, 21, 23, 25, 27 and 29. All of the edges fall on a circle 30 which has a center at 32.

Opposed faces 18 and 24 are parallel, and the edges 21 and 27 are each offset from the center 30 by a distance X, such that the faces 26 and 28 are at an angle of 30° with a vertical plane 34 which is at right angles with the faces 18 and 24; face 20 is at an angle of 20° with a vertical plane 36 which is parallel with the plane 34; and face 22 forms an angle of 40° with the plane 36. Faces 24 and 28 are the same width; faces 20 and 22 are of the same width; and faces 18 and 26 are of the same width.

One of the more important features of the present invention is that extensions of faces 20 and 26 of the narrower set of faces form an angle of 10°, and, in like manner, extensions of the other or wider set of opposed faces 22 and 28 form an angle of 10°. We have discovered that 10° is the preferred inclination of such opposed faces for wedging between the slowly converging walls of a crack or similar opening in a rock.

Another important feature is that the median distance between the narrower set of faces 20 and 26 is less than the median distance between the wider set of faces 22 and 28, whereby the same chock can be wedged in the same 10° crack (FIG. 6) but at different vertical positions, depending upon which set of faces engage the opposed walls 14 and 16 of the crack, i.e. by merely rotating the chock approximately 60°. However, it should be understood that the advantage of this feature is not the fact that the same chock can fit in two different positions in the same crack, but that the same chock can be used in cracks with different spacing between walls. Stating it somewhat differently, with a chock constructed in accordance with the teachings of the present invention, one such chock can take the place of two conventional chocks, and in mountaineering where the weight of the equipment is a critical factor, the present chock constitutes a valuable and significant advance over prior known chocks.

Yet another important feature of the present invention is the providing of a series or set of chocks of different sizes, so that by carrying a set of such chocks, a climber will have available a 10° chock for any width of crack from a predetermined minimum width to a predetermined maximum width. In actuality, the minimum width is the distance between the smaller end of the narrower set of faces of the smallest chock and the maximum width is the distance between the larger end of the wider set of faces of the largest chock.

In FIg. 5 are shown three chocks, 10, 110, and 210, of like configuration but with corresponding faces of different widths, whereby said three chocks can fit in any 10° crack which ranges in width from the smaller end of the narrower set of faces of chock 10 to the larger end of the wider set of faces of chock 210.

For convenience of discussion, the numbers which identify the edges of chock 19 (FIG. 5) are the same as the numbers used with the chock of FIG. 2, and like numbers are used with chocks 110 and 210 (FIG. 5), but with the numbers increased in each instance by 100. Thus, referring to FIG. 5, the distance between the edges 21–25 (the smaller end of the narrower set of faces) is less than the distance 19–27 (the larger end of the narrower set of faces); the distance 19–27 is the same as the distance 23–27 (the smaller end of the wider set of faces); and the distance 23–27 is less than the distance 21–29 (the larger end of the wider set of faces. And, the distance 21–29 of chock 10 is the same as the distance 121–125 of the next larger chock, i.e. the smaller end of the narrower set of faces at ten degrees.

In chock 110 (FIG. 5), the distance 121–125 is less than the distance 119–127; the distance 119–127 is the same as the distance 123–127; and the distance 123–127 is less than the distance 121–129.

In comparing the next size of chock 210 with chock 110 (FIG. 5) the distance 121–129 of chock 110 is the same as the distance 221–225 of chock 210.

Thus, it is apparent that with a set of chocks constructed in accordance with the teachings of the present invention, the climber has a "stick" of chocks with opposed faces at a 10° angle, ranging in size from the smaller end of the narrower set of faces of the smallest chock, up to the width of the larger end of the wider set of faces of the largest chock.

A further advantage of the present invention is yet another set of 10° "wedges" as provided by the ends of the chocks. Referring to FIGS. 3 and 4, the chocks have opposed ends 34 and 36, the extensions of which also form an angle of 10°, and, because the length of the chock between the ends 35–36 increases with an increase in the size or "diameter" of the chock, the ends provide another range of sizes at 10°.

All of the chocks are provided with at least two, spaced-apart, circular passageways 38 and 40 (FIGS. 3 and 4) which extend through the chock from the face 18 to the opposed parallel face 24. These receive the rope (or web) sling 12 to which a carabiner can be attached. It will be noted that with the rope sling 12 depending from the face 24 (FIG. 1), both sets of 10° faces can be used for engaging spaced walls 14 and 16, without interferring with or binding the sling 12.

Because weight of equipment is an ever present problem in mountaineering, the larger chocks have a large, axial passageway or cavity 42 extending therethrough, but the smaller chocks are solid, except for the sling passageways.

Thus, it is apparent that there has been provided a novel irregular, polygonal mountaineering chock and a series of such chocks which fulfill all of the objects and advantages sought therefor.

We claim:

1. A mountaineering chock having a polygonal body with opposed ends and a plurality of side faces which intersect at longitudinally extending edges, in which:

there are two sets of opposed faces, with the opposed faces in in each set defining an acute angle;

the median distance between the opposed faces in one set is different from the median distance between the opposed faces in the other set, to provide a narrower set of faces and a wider set of faces; and means are provided for receiving a rope sling in supporting engagement with said body and extending therefrom between the opposed faces of each of the sets of faces.

2. A mountaineering chock as described in claim 1, in which the acute angle of each set of faces is the same.

3. A mountaineering chock as described in claim 1, in which the acute angle between each set of faces is approximately 10°.

4. A mountaineering chock as described in claim 1, in which:

the polygonal body is hexagonal; and there are two additional opposed faces which are substantially parallel.

5. A mountaineering chock as described in claim 4, in which the rope sling receiving means includes two, spaced apart passageways which extend through the body from one of said parallel faces to the other parallel face.

6. A mountaineering chock as described in claim 5, in which the axes of said passageways extend between the opposed faces of each of the two sets of faces.

7. A mountaineering chock as described in claim 1, in which each set of opposed faces has a larger end and a smaller end and the distance between the larger end of the narrower set of faces is approximately the same as the distance between the smaller end of the wider set of faces.

8. A mountaineering chock as described in claim 1, in which the opposed ends define an angle of approximately 10°.

9. A mountaineering chock as described in claim 1, which further includes a longitudinally extending passageway through the body.

10. A mountaineering chock as described in claim 1, in which the longitudinally extending edges are substantially parallel.

11. A mountaineering chock as described in claim 10, in which the longitudinally extending edges are equi-distant from the center of the body.

12. A mountaineering chock as described in claim 4, in which two of the faces adjacent one of said parallel faces form angles of about 60° and 70° therewith, respectively, and the other two faces adjacent the other parallel face form angles of about 50° and 60° therewith, respectively.

13. A series of like mountaineering chocks of increasing size, each having a polygonal body with opposed ends and a plurality of side faces which intersect at longitudinally extending edges, in which:

each chock contains two sets of opposed faces, with the opposed faces in each set defining an acute angle, whereby each set of opposed faces has a larger end and a smaller end;

in each chock, the median distance between the opposed faces in one set is different from the median distance between the opposed faces in the other set, to provide a narrower set of faces and a wider set of faces;

the larger end of the wider set of faces of a chock is approximately the same width as the smaller end of the narrower set of faces of the next larger chock in the series; and means are provided for receiving a rope sling in supporting engagement with said body and extending therefrom between the opposed faces of each of the two sets of faces.

14. A series of like mountaineering chocks of increasing size as described in claim 13, in which each set of opposed faces defines an angle of 10°.

15. A series of like mountaineering chocks of increasing size as described in claim 13, in which the distance between the larger end of the narrower set of faces of each chock is approximately the same as the distance between the smaller end of the wider set of faces of the chock.

16. A series of like mountaineering chocks of increasing size as described in claim 13, in which:

each chock is of hexagonal configuration, and contains two additional opposed faces which are substantially parallel.

17. A series of like mountaineering chocks of increasing size as described in claim 16, in which the rope sling receiving means of each chock includes two spaced apart passageways which extend through the body from one of said parallel faces to the other parallel face.

* * * * *